US007100251B2

(12) United States Patent
Howell

(10) Patent No.: US 7,100,251 B2
(45) Date of Patent: Sep. 5, 2006

(54) BREAKAWAY BUCKLE

(75) Inventor: Frank A. Howell, Oxford, ME (US)

(73) Assignee: Illinois Tool Works, Inc., Glenview, IL (US)

( * ) Notice: Subject to any disclaimer, the term of this patent is extended or adjusted under 35 U.S.C. 154(b) by 491 days.

(21) Appl. No.: 10/736,881

(22) Filed: Dec. 16, 2003

(65) Prior Publication Data

US 2006/0123607 A1 Jun. 15, 2006

Related U.S. Application Data

(63) Continuation-in-part of application No. 10/354,720, filed on Jan. 30, 2003, now abandoned, which is a continuation-in-part of application No. 10/103,264, filed on Mar. 21, 2002, now Pat. No. 6,637,083.

(51) Int. Cl.
*A44B 11/25* (2006.01)

(52) U.S. Cl. ..... 24/602; 24/614; 24/615; 24/647

(58) Field of Classification Search ..... 24/311–315, 24/170, 171, 193, 602, 598.1, 598.2, 598.4, 24/614, 615, 625, 664, 647, 265 CD, 641, 24/200, 180, 340, DIG. 43–DIG. 49
See application file for complete search history.

(56) References Cited

U.S. PATENT DOCUMENTS 1,158,827 A * 11/1915 Moricet ..... 24/69 R
2,522,790 A * 9/1950 Johnston ..... 294/82.31
2,933,795 A * 4/1960 Meeker ..... 24/647
4,162,715 A * 7/1979 Coulombe ..... 280/801.1
4,458,392 A * 7/1984 Pogharian et al. ..... 24/664
4,793,032 A * 12/1988 Crowle ..... 24/615
4,864,700 A * 9/1989 Kasai ..... 24/579.09
5,102,176 A * 4/1992 Duggal ..... 294/82.31
5,205,021 A * 4/1993 Durand ..... 24/163 R
5,355,562 A * 10/1994 Matoba et al. ..... 24/625
5,435,047 A 7/1995 Colpo
5,440,792 A 8/1995 Ida
5,774,947 A 7/1998 Anscher
5,832,573 A * 11/1998 Howell ..... 24/664
6,076,237 A 6/2000 Goorhouse
6,154,936 A * 12/2000 Howell et al. ..... 24/625
6,170,133 B1 1/2001 Uehara
6,481,069 B1 11/2002 Cheng
6,637,083 B1 * 10/2003 Howell ..... 24/614

* cited by examiner

*Primary Examiner*—Jack W. Lavinder
(74) *Attorney, Agent, or Firm*—Gauthier & Connors, LLP

(57) ABSTRACT

A breakaway buckle has a keeper attachable to a first strap and a secure attachable to a second laterally disposed strap. The secure has a tongue releasably retained in the keeper by overlapping interlocked locking surfaces on both components. Cam surfaces on the secure and keeper coact in response to lateral and/or torsional forces exerted on the secure to reduce the area of overlap between the locking surfaces and thereby facilitate separation of the secure from the keeper.

10 Claims, 6 Drawing Sheets

BREAKAWAY BUCKLE

CROSS REFERENCE TO RELATED APPLICATIONS

This application is a continuation-in-part of U.S. Ser. No. 10/354,720 filed Jan. 30, 2003 now abandoned, which in turn is a continuation-in-part of U.S. Ser. No. 10/103,264 filed Mar. 21, 2002, now U.S. Pat. No. 6,637,083.

BACKGROUND OF THE INVENTION

1. Field of the Invention

This invention relates to buckles of the type employed to interconnect manually releasable straps on backpacks and the like, and is concerned in particular with the incorporation of a breakaway release feature in such buckles.

2. Description of the Prior Art

Shoulder straps on backpacks tend to spread apart and slip off the shoulders of the wearer as he or she walks or moves about. As a solution to this problem, it is known to employ a length of web strap spanning over the sternum to connect the shoulder straps. The "sternum strap" is anchored to the face of each shoulder strap with friction fittings that can be adjusted vertically as desired. This configuration typically includes a side-release buckle that allows the wearer to connect or part the sternum strap as needed to don and doff the backpack.

The known side-release buckles suffer from a number of problems, including, inter alia, lack of durability, difficulty in accessing release mechanisms, resistance to releasing under heavy loads, etc. Most of these problems have been addressed by the lanyard-releasable buckle disclosed in U.S. Pat. No. 6,637,083.

There remains, however, a problem stemming from the buckle's inability to open unless its release mechanism is manually operated or it breaks under heavy loading. Thus, when employed as a sternum buckle, injury, particularly to the throat area and larynx, may result if the wearer attempts to doff the backpack without first releasing the buckle.

There exists a need, therefore, for a buckle that is not only readily releasable by manually activating its release mechanism, but that also is automatically releasable in a "breakaway" fashion if the sternum strap is subjected to lateral and/or torsional forces. This typically will be the case in emergency situations where the wearer is prevented or distracted from manually releasing the buckle.

SUMMARY OF THE INVENTION

A breakaway buckle in accordance with the present invention includes a keeper attachable to a first strap which typically will comprise the shoulder strap of a backpack or the like, and a secure attachable to the end of a second laterally extending strap, typically a sternum strap providing an interconnection between two shoulder straps.

The keeper has a bottom wall cooperating with side walls to define a receiving channel extending from an open front end to a rear end closed by a back wall. A lever overlies the channel. The lever has a first downwardly convex locking surface and first cam surfaces, and is resiliently deflectable between a normally closed lowered position and an open raised position.

The secure has a tongue with a second upwardly convex locking surface and second cam surfaces. The tongue is configured and dimensioned for insertion into the keeper channel through its open front end, and into a seated position against the keeper back wall and beneath its lever. The lever is deflectable upwardly from its closed position by entry of the tongue into the keeper channel. When the secure arrives at its seated position, the cover snaps downwardly into its closed position, placing its first locking surface in an interlocked abutting relationship at an area of overlap with the second locking surface on the secure. The first and second cam surface are arranged to coact in response to lateral and/or twisting movement of the secure relative to the keeper by decreasing the area of overlap between the interlocked locking surfaces, thereby facilitating axial withdrawal of the secure tongue from the keeper channel.

Other features and advantages of the present invention will now be described in greater detail with reference to the accompanying drawings, wherein:

DETAILED DESCRIPTION OF PREFERRED EMBODIMENTS

Figure 1:
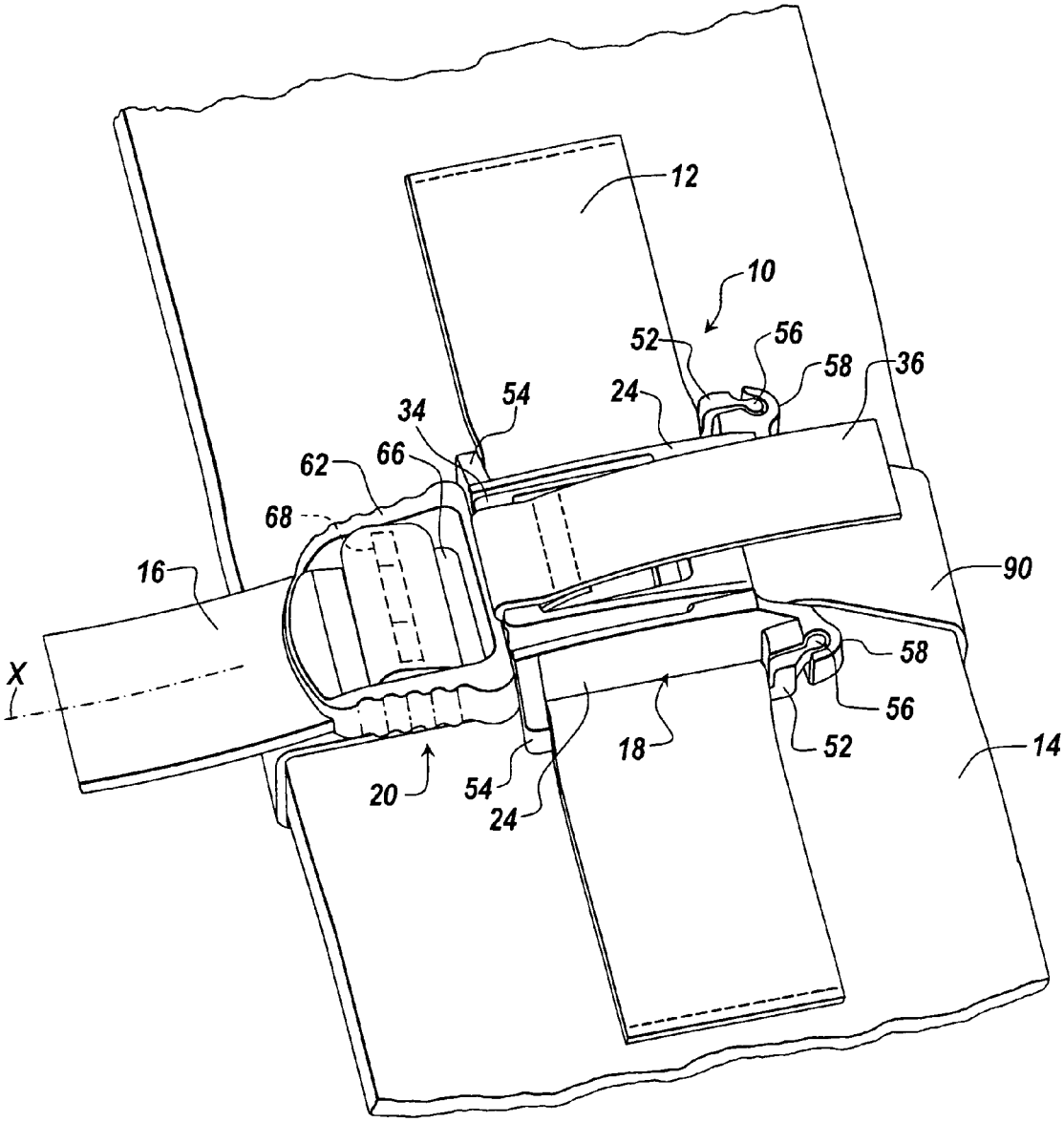
FIG. 1 is a perspective view of a breakaway buckle in accordance with the present invention, the buckle being depicted in its operative position providing a releasable connection between an adjustment strap on the shoulder pad of a backpack and a sternum strap.
Figure 2:
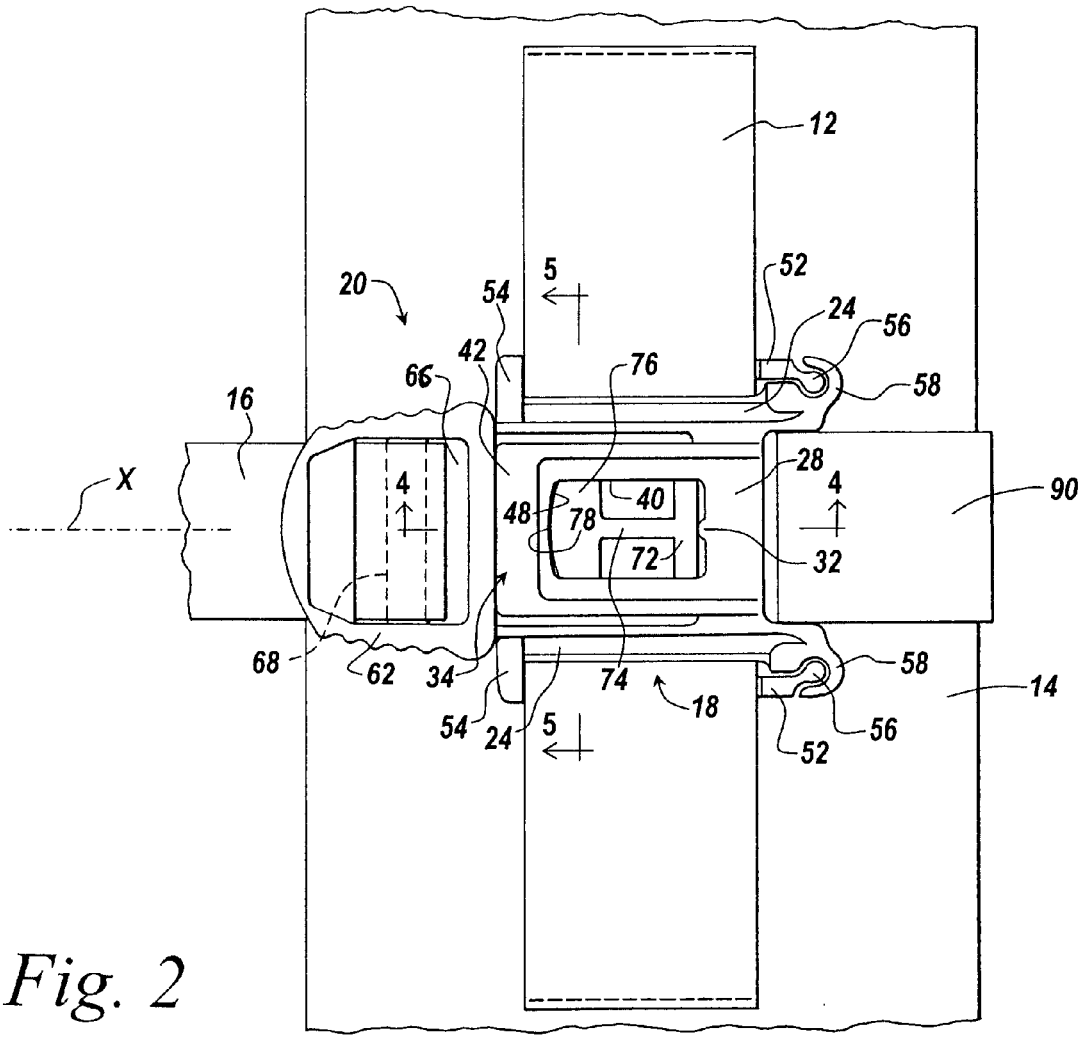
FIG. 2 is a plan view of the buckle shown in FIG. 1.
Figure 3:
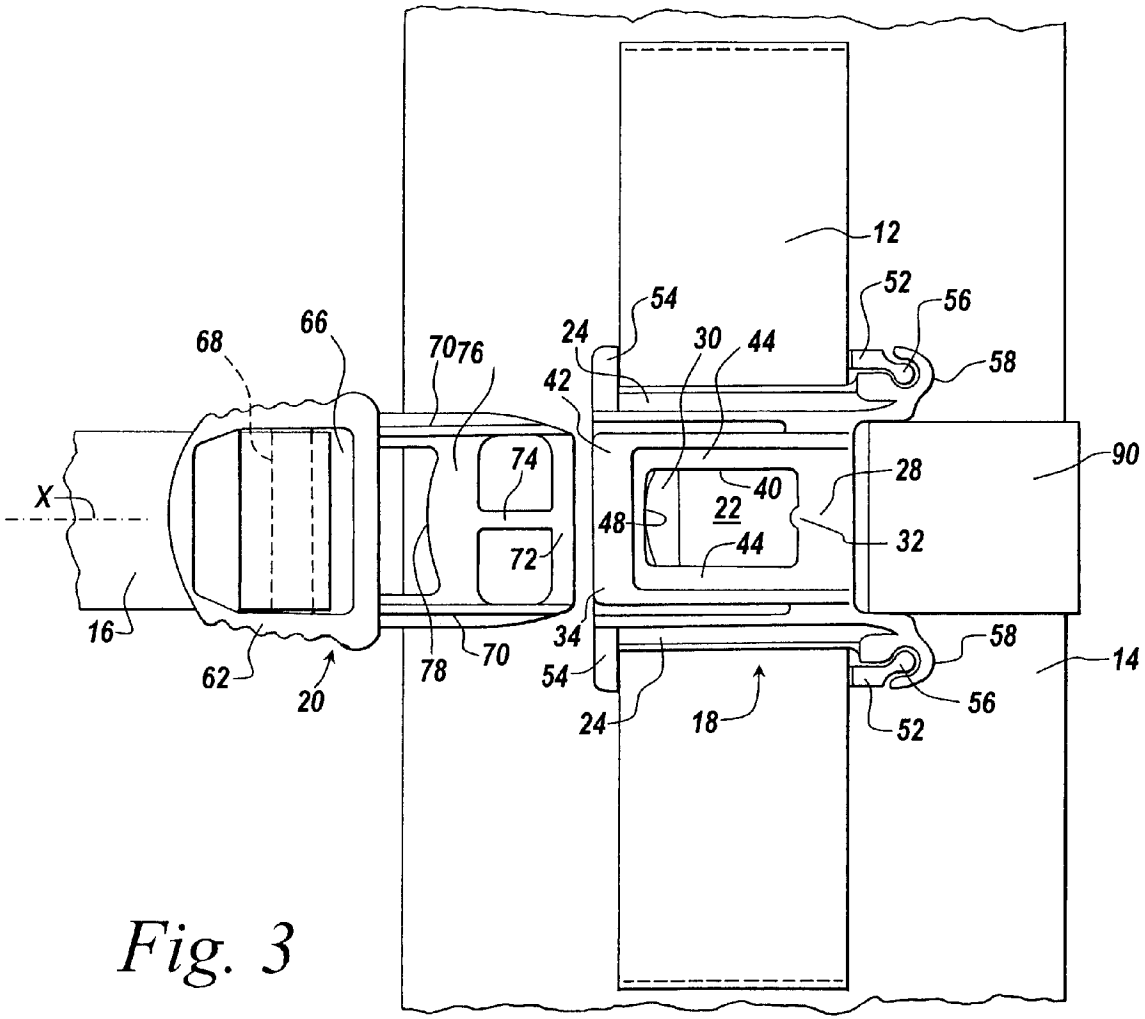
FIG. 3 is a plan view similar to FIG. 2 showing the secure withdrawn from the keeper.

With reference initially to FIGS. 1–3, a breakaway buckle in accordance with the present invention is generally depicted at 10. In its operative position as shown, the buckle provides a releasable connection between a "first" adjustment strap 12 sewn to the shoulder pad 14 of a backpack (not shown), and a "second" sternum strap 16 extending along an axis "X" disposed laterally with respect to strap 12.

The buckle 10 is a two part assembly consisting of a keeper 18 attachable to strap 12, and a secure 20 attachable to strap 16. As shown in FIG. 3, when the buckle is released, the secure 20 is separated from the keeper 18.

With reference additionally to FIGS. 4–7, it will be seen that the keeper 18 comprises a bottom wall 22 cooperating with side walls 24 to define a receiving channel 26 alignable with the axis "X". The receiving channel extends from an open front end to a rear end closed by a back wall 28. The bottom wall 22 is interrupted by an opening 30 adjacent to the front end of receiving channel 26, and the back wall 28 has an abutment 32 projecting therefrom into the receiving channel.

A lever 34 is integrally joined to and projects from the back wall 28 to overlie the receiving channel 26. The lever is resiliently deflectable between a normally closed lowered position and a raised open position. Manual deflection of the lever from its closed to its open position is facilitated by a lanyard strap 36 looped through a transverse slot 38 at the forward lever end.

A generally rectangular opening 40 in the lever is bordered by the back wall 28, an opposite front wall 42, and connecting side walls 44. The front side of wall 42 is configured to provide a first ramp surface 46 (See FIG. 4), and the back side of wall 42 is configured to provide a first locking surface 48. When viewed in plan (FIGS. 2 and 3), the first locking surface 48 is concave, and when viewed in a direction transverse to channel 26 (FIGS. 5A and 5B), the first locking surface is downwardly convex. The outer surfaces of the side walls 44 are configured to provide inwardly inclined first cam surfaces 50.

External side bars 52 are integrally joined at their proximate ends to the keeper side walls 24 as at 54, and are provided at their distal ends with hook-shaped noses 56 configured to be snap fitted into side wall sockets 58. The side bars 52 cooperate with the keeper side walls 24 to define slots 60 for accepting the adjustment strap 12. The strap 12 may either be threaded through the slots 60 before being sewn to the shoulder pad 14, or if the strap is already sewn in place, it can be laterally inserted in the slots by first disengaging the noses 56 from their respective sockets 58.

The secure 20 includes an externally ribbed base portion 62 and an integral forwardly projecting tongue 64. The base portion 62 has an interior opening 66 bridged by a rib 68 over which an end of the sternum strap 16 is looped and thus connected. The tongue 64 comprises parallel laterally spaced legs 70 projecting from the base portion 62. The distal ends of the legs 70 are connected by a front rib 72, and a middle leg 74 joins the front rib 72 to an intermediate rib 76.

The intermediate rib 76 is configured to provide a second locking surface 78. As viewed in plan (FIGS. 2 and 3), the second locking surface is convex, and as viewed in a direction transverse to the receiving channel 26, the second locking surface is upwardly convex.

Figure 5A:
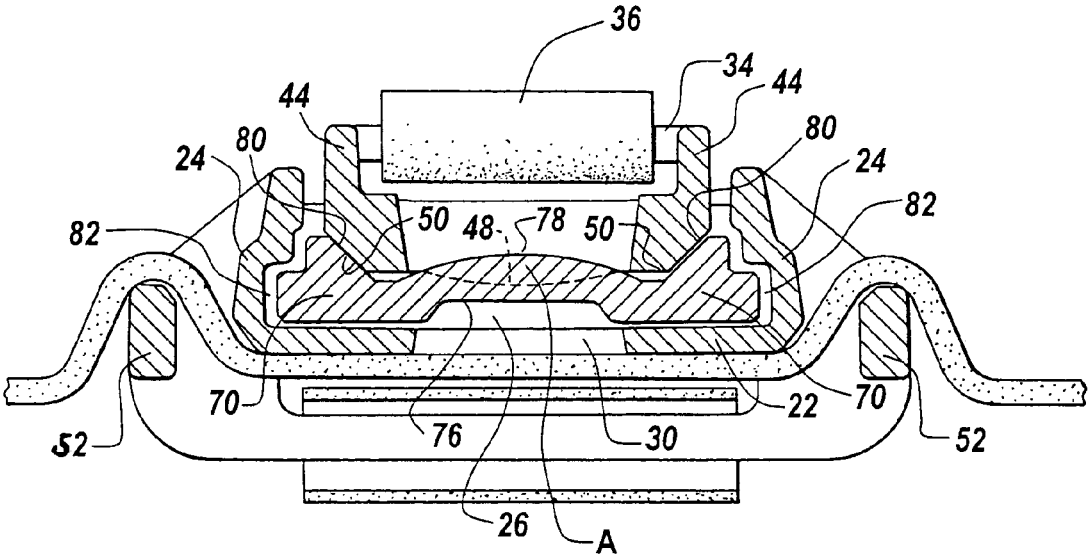
FIG. 5A is a sectional view taken along line 5—5 of FIG. 2.
Figure 5B:
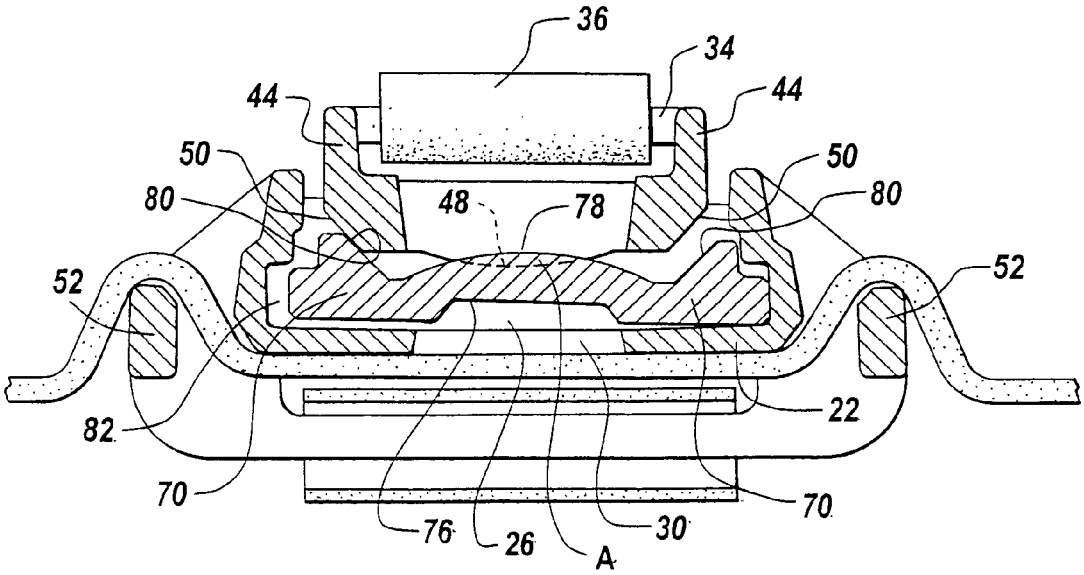
FIG. 5B is a view similar to FIG. 5A showing the secure in the process of being disengaged from the keeper as a result of lateral and/or torsional forces being exerted on the sternum strap.
Figure 6:
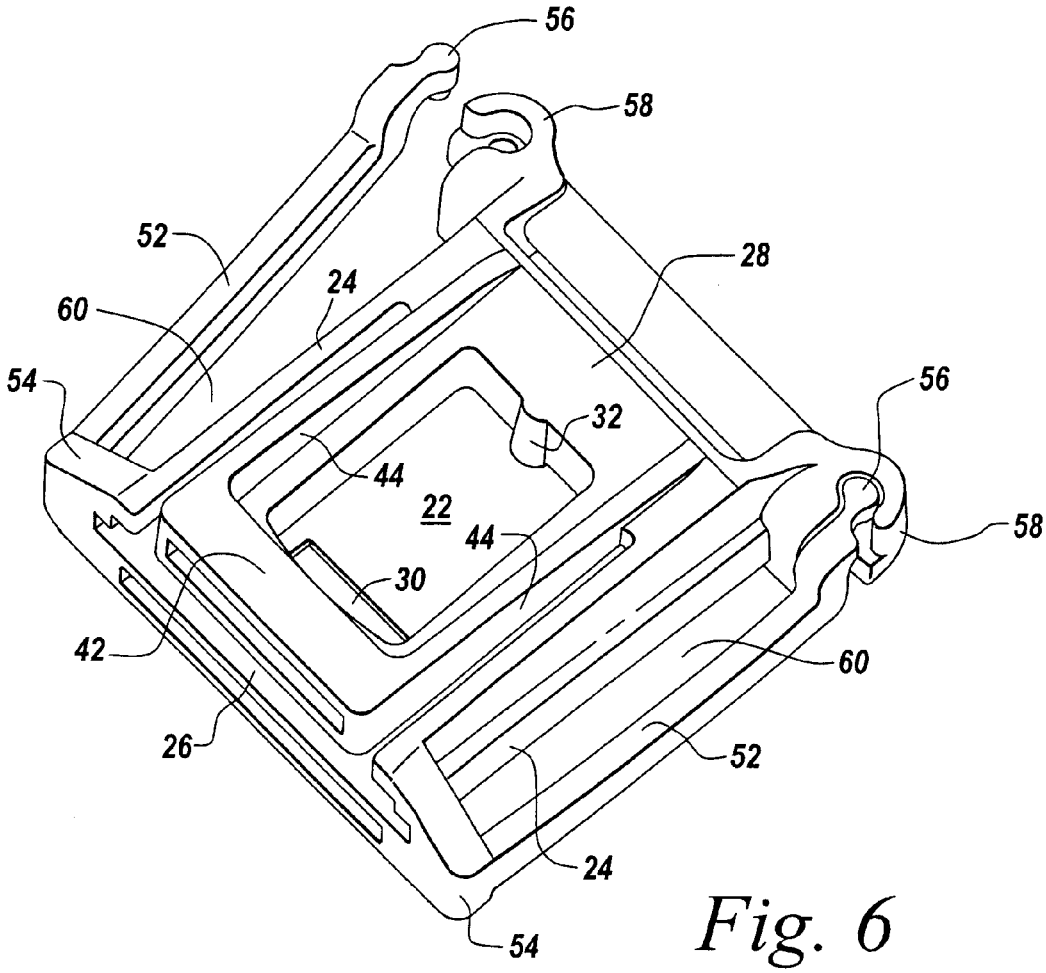
FIG. 6 is a perspective view of the keeper.
Figure 7:
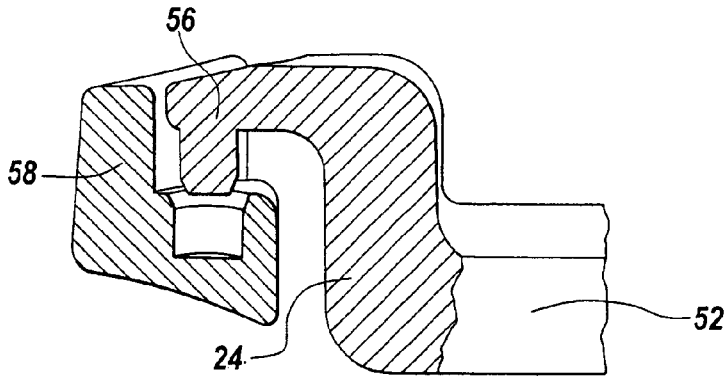
FIG. 7 is an enlarged sectional view taken through a detachable end of one of the side bars on the keeper, with the end hook particularly received in the housing socket.

As can be best seen in FIGS. 5A and 5B, the side legs 70 of the tongue 64 are provided with second cam surfaces 80 arranged to coact with the first cam surfaces 50 of the keeper. The width of the tongue is smaller than the width of the receiving channel 26, thus providing side clearances as at 82.

Figure 4:
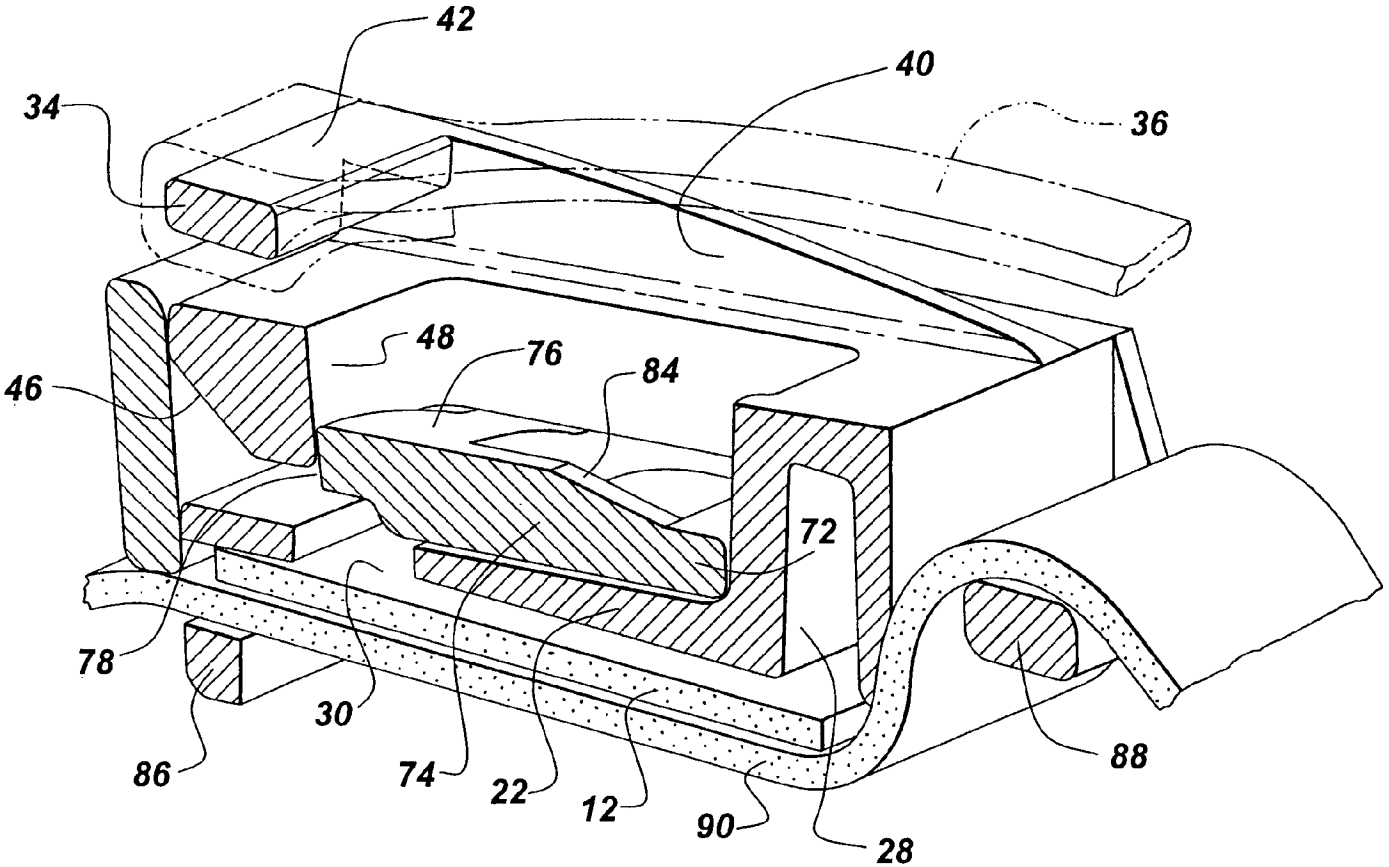
FIG. 4 is a sectional perspective view taken along line 4—4 of FIG. 2.

As is best shown in FIG. 4, the middle leg 74 of the tongue 64 is configured to provide a second ramp surface 84. As the tongue enters the receiving channel, the second ramp surface coacts in sliding engagement with the first ramp surface 46 to gradually deflect the lever 34 upwardly from its normally closed position. When the intermediate rib 76 passes beyond the front lid wall 46, the tongue 64 is seated with its front rib 72 bearing against abutment 32 on back wall 28, and the lever snaps downwardly, resulting in the first locking surface 48 coacting in an interlocked relationship with the second locking surface 78 on the tongue 64 at an area of overlap "A" (See FIGS. 5A and 5B).

The resilient downward force of the lever 34 acts via the inclined interfaces between the first and second cam surfaces 50, 80 to center the tongue 64 in the channel 26. Moreover, when the sternum strap 16 is tensioned in the direction of axis X (socalled "straight line" loading), the concave/convex relationship (as viewed in plan) of the first and second locking surfaces 48, 78 further serves to urge the tongue 64 centrally in the channel 26. Centering the tongue 64 in the channel 26 maximizes the area of overlap A between the locking surfaces 48, 78, which in turn maximizes the ability of the buckle to remain securely closed under heavy straight line loading.

The buckle may be manually released by pulling on the lanyard 36 to raise the lever 34 and thus reduce the area A of overlap between the locking surfaces 48, 78. The buckle may also be released in a breakaway mode by subjecting the sternum strap 16 and the secure 20 to which it is connected to lateral and/or torsional forces. As shown in FIG. 5B, when this occurs, the tongue 64 will be urged from its position in the center of the channel 26 into an offset position, with the result that one or the other of the pairs of cam surfaces 50, 80 will coact to push the lever upwardly and thereby decrease the area of overlap between the locking surfaces 48, 78. This reduction in overlap will facilitate a pulling apart of the secure from the keeper.

Preferably, as shown in FIG. 4, the keeper 18 will additionally include external front and rear bars 86, 88 defining slots through which an auxiliary strap 90 can be threaded and looped around the shoulder pad 14 to stabilize the keeper 18 against movement relative to the secure 20.

I claim:

1. A breakaway buckle for providing a releasable connection between a first strap and a second strap extending along an axis disposed laterally with respect to the first strap, said buckle comprising:

a keeper attachable to the first of said straps, said keeper having a bottom wall cooperating with side walls to define a receiving channel alignable with said axis and extending from an open front end to a rear end closed by a back wall, a lever integrally joined to and projecting from said back wall to overlie said channel, said lever having a first locking surface and being resiliently deflectable between a normally closed lowered position and a raised position with respect to said bottom wall;

a secure attachable to said second strap, said secure having a tongue with a second locking surface, said tongue being configured and dimensioned for insertion into said receiving channel through the open front end thereof and into a seated position against said back wall and beneath said lever, said lever being deflectable from said lowered to said raised position in response to entry of said tongue into said channel, and, in response to arrival of said tongue at its' seated position, being resiliently returnable to said lowered position with said first locking surface coacting in an interlocked abutting relationship at an area of overlap with said second locking surface to thereby resist withdrawal of said tongue from said channel;

first and second cam surfaces located respectively on said keeper and said secure, said cam surfaces being arranged to coact in decreasing said area of overlap in response to lateral and/or twisting movement of said secure relative to said keeper, thereby facilitating axial withdrawal of said tongue from said channel; and means for manually deflecting said lever from said lowered to said raised positions.

2. The buckle of claim 1 wherein the width of said channel is greater than the width of said tongue.

3. The buckle of claim 1 wherein said lever and said tongue are provided respectively with first and second ramp surfaces, said ramp surfaces being arranged to coact in sliding engagement during entry of said tongue into said channel to thereby resiliently deflect said lever from said closed position to said raised position.

4. The buckle as claimed in claim 1 wherein said secure includes a base attachable to said second strap, and wherein said tongue comprises parallel laterally spaced legs projecting from said base, said legs being connected at their distal ends by a front rib and by an intermediate rib at a location spaced between said front rib and said base.

5. The buckle as claimed in claim 4 wherein the back wall of said keeper includes an abutment arranged to bear against said front rib when said tongue is in its seated position.

6. The buckle as claimed in claim 4 wherein said second locking surface is located on said intermediate rib.

7. The buckle as claimed in claim 1 wherein, as viewed in a direction transverse to said channel, said first locking surface is downwardly convex and said second locking surface is upwardly convex.

8. The buckle as claimed in claim 1 wherein, as viewed in plan, said first and second locking surfaces coact in a convex/concave relationship.

9. The buckle as claimed in claim 2 wherein said first and second cam surfaces are arranged in mating pairs on opposite sides of the center of said channel.

10. The buckle as claimed in claim 9 wherein said mating pairs of cam surfaces coact along oppositely inclined interfaces to thereby resiliently align said tongue with the center of said channel.

* * * * *